US006736989B2

(12) United States Patent
Stewart et al.

(10) Patent No.: US 6,736,989 B2
(45) Date of Patent: May 18, 2004

(54) REDUCTION OF HF

(75) Inventors: Harry E. Stewart, Fort Pierce, FL (US); Donald B. MacElwee, Wayne, PA (US)

(73) Assignee: Powsus, Inc., Fort Pierce, FL (US)

( * ) Notice: Subject to any disclaimer, the term of this patent is extended or adjusted under 35 U.S.C. 154(b) by 0 days.

(21) Appl. No.: 10/318,901

(22) Filed: Dec. 13, 2002

(65) Prior Publication Data

US 2003/0218148 A1 Nov. 27, 2003

Related U.S. Application Data

(63) Continuation-in-part of application No. 09/756,256, filed on Jan. 8, 2001, now abandoned, which is a continuation of application No. 09/427,891, filed on Oct. 26, 1999, now abandoned.

(51) Int. Cl.[7] ..... A62D 1/08

(52) U.S. Cl. ..... 252/8; 252/2; 252/3; 252/7; 252/8.05; 252/4

(58) Field of Search ..... 252/8, 2, 3, 7, 252/8.05, 4

(56) References Cited

U.S. PATENT DOCUMENTS 3,755,163 A * 8/1973 Bröll et al. ..... 252/7
4,089,804 A * 5/1978 Falk
4,226,727 A * 10/1980 Tarpley, Jr. et al. ..... 252/8
4,234,432 A * 11/1980 Tarpley, Jr. ..... 252/8
4,459,213 A * 7/1984 Uchida et al. ..... 252/8.05
4,652,383 A * 3/1987 Tarpley, Jr. et al. ..... 252/8
5,053,148 A * 10/1991 von Bonin ..... 252/8.05
5,055,208 A * 10/1991 Stewart et al. ..... 252/8
5,135,054 A * 8/1992 Nimitz et al. ..... 169/42
5,196,137 A * 3/1993 Merchant ..... 134/38
5,218,021 A * 6/1993 Clark et al. ..... 524/56
5,219,474 A * 6/1993 Song et al. ..... 252/8
5,466,386 A * 11/1995 Stewart et al. ..... 252/2
5,833,874 A * 11/1998 Stewart et al. ..... 252/8
5,909,776 A * 6/1999 Stewart et al. ..... 169/26

* cited by examiner

*Primary Examiner*—Joseph D. Anthony
(74) *Attorney, Agent, or Firm*—Frommer Lawrence & Haug LLP; Ronald R. Santucci

(57) ABSTRACT

The invention provides for a substantially non-aqueous, flame extinguishing composition for extinguishing a fire at the sight of a potential flame having a flurocarbon in admixture with a gelled powder additive having salts of weak acids which decompose at the temperature of the sight to reduce or eliminate HF released by the composition when used to extinguish flames.

13 Claims, 6 Drawing Sheets

REDUCTION OF HF

This application is a continuation-in-part of U.S. patent application Ser. No. 09/756,256, filed on Jan. 8, 2001, now abandoned, which, in turn, is a continuation of U.S. patent application Ser. No. 09/427,891, filed on Oct. 26, 1999, now abandoned.

FIELD OF THE INVENTION

The Invention relates to a composition to control, reduce or eliminate hydrogen fluoride (HF). Documents cited herein in the following text are incorporated by reference.

BACKGROUND OF THE INVENTION

The literature is replete with descriptions of fire-extinguishing compositions. Included in such compositions are gelled compositions comprising dry solid chemicals for extinguishing flames and inhibiting oxidation (for example sodium and potassium bicarbonate) and vaporizing organic liquids like brominated hydrocarbons. The latter compounds also extinguish flames very effectively. The mechanism by which brominated hydrocarbons extinguish flames is two-fold. The primary mechanism involves the termination of free radical ion reactions that sustain combustion and a secondary mechanism is heat abstraction associated with a high vapor heat capacity and a high heat of vaporization.

A number of perfluorocarbons, chlorofluoro-carbons (CFC) and hydrofluorocarbons (HFC) by themselves have been identified as potentially useful to extinguish fires in flooding applications, and being free of bromine content or low in chlorine content, have little or no ozone depletion potential (ODP). Representative of these perfluorocarbons, chlorofluorocarbons and hydrofluorocarbons are 2-chloro-1,1,1,2-tetrafluoroethane, pentafluoroethane, 1,1,2,2-tetrafluoroethane, 1,1,1,2-tetrafluoro-ethane, 1,1,1-trifluoroethane, perfluorocyclopropane, perfluoropropane, perfluorocyclobutane and the like; see U.S. Pat. No. 5,135,054, which is incorporated herein by reference. The chlorofluorocarbon compounds are also referred to by the "CFC" system of nomenclature, and the hydrofluorocarbons by the "HFC" system. Under these systems, the first digit represents the number of carbon atoms minus one (and is omitted if zero); the second digit represents the number of hydrogen atoms plus one; and the third digit represents the number of fluorine atoms. For example, HFC-125 represents pentafluoroethane.

U.S. Pat. No. 5,833,874 relates to fire-extinguishing compositions of low ozone depletion potential comprising dry particles of fire-extinguishing agents dispersed in a gel of liquefied volatile perfluorocarbons, chlorofluorocarbons or hydrofluorocarbons. The dry particles are compatibilized with the carrier gel by the presence of a surfactant system composed of a non-ionic surfactant, a film forming fluorocarbon surfactant and a phosphorus containing antiflocculent. The compositions of the patent are hybrids, i.e., gelled formulations of dry powder agents delivered in liquefied hydrofluorocarbons and chlorofluorocarbons.

Extinguishing open flames within a confined space such as a room in a building, an engine compartment in a vehicle, aircraft interiors, enclosed fuel storage areas, electric control boxes, storage containers, hazardous material storage facilities and the like has always posed problems of speed in extinguishing and clean-up requirements after the flame is extinguished. The first problem is related to placement of a fire extinguishing composition at the flame site, in sufficient quantity to extinguish a flame rapidly and on demand. The second problem is related to the nature of the fire extinguisher composition and its residues after flame extinction.

Normally, the HFC, PFC and HCFC gases that are developed to replace halons generate unacceptable high quantities of hydrogen fluoride when putting out fires, thereby running the risk of killing the persons in the "occupied" space from which the fire emanated even when the fire is put out. There are no HFC, PFC or HCFC gases that are exceptions to this statement. This covers the list of gases that are now EPA permitted to be used for fire extinguishment.

Thus there is a need for gaseous halon replacements that have demonstrated a greater affinity for HF production in fire scenarios. There is also a need for gas-based extinguishants for automatic fire extinguishers for moving vehicles, planes, ships, and electronics which are enclosed or semi-enclosed and thus need the elimination of HF to occur relatively rapidly.

OBJECTS AND SUMMARY OF THE INVENTION

It is therefore a principal object of the invention to overcome the shortcomings of the prior art heretofore mentioned.

It is a further object of the invention to provide a method for reducing HF to EPA accepted levels.

In accordance with one embodiment of the present invention, a method is provided for formulating a substantially non-aqueous, flame-extinguishing composition which uses a fluorocarbon gas to extinguish a fire to reduce the amount of HF given off when the fluorocarbon gas is applied to the fire, comprising providing a first amount of a fluorocarbon gas which produces HF when exposed to a fire; providing a gelled powder additive, said additive comprising salts of weak acids which decompose at the temperature.

In accordance with another embodiment of the present invention, a substantially non-aqueous, flame-extinguishing composition used to extinguish a fire is provided, comprising: a fluorocarbon gas in admixture with approximately 3–7% by weight of a gelled powder additive, said additive comprising salts of weak acids which decompose at the temperature of the fire.

In accordance with a further embodiment of the present invention, a substantially non-aqueous, flame-extinguishing composition used to extinguish a fire is provided, comprising a flame extinguishing fluorocarbon gas component comprising at least one hydrofluorocarbon gas, which produces HF gas when exposed to fire, in admixture with approximately 3–20% by weight of a gelled salt of a weak acid which decomposes when exposed to fire and which reduced the amount of HF gas produced by the hydrofluorcarbon gas, the relative quantities of salt and hydrofluorcarbon gas selected to reduce HF gas production to within a preselected limit.

In accordance with a yet another embodiment of the present invention, a method is provided for formulating a substantially non-aqueous, flame-extinguishing composition which uses a fluorocarbon gas to extinguish a fire, to reduce the amount of HF given off when the fluorocarbon gas is applied to the fire, comprising: providing a first amount of a fluorocarbon gas which produces HF when exposed to a fire; providing a gelled powder additive, said additive comprising salts of weak acids which decompose at the temperature of the fire; selecting a maximum HF emission target level; and adjusting the relative amounts of the additive and the fluorocarbon gas so that when the fluorocarbon gas is mixed with the additive and applied to a fire, no more than the target HF emission is given off, wherein the salt is an ammonium polyphosphate, and wherein the additive comprises 15–20% by weight of the admixture.

In accordance with a still further embodiment of the present invention, a method is provided for formulating a substantially non-aqueous, flame-extinguishing composition which uses a fluorocarbon gas to extinguish a fire, to, reduce the amount of HF given off when the fluorocarbon gas is applied to the fire, comprising: providing a first amount of a fluorocarbon gas which produces HF when exposed to a fire; providing a gelled powder additive, said additive comprising salts of weak acids which decompose at the temperature of the fire; selecting a maximum HF emission target level; and adjusting the relative amounts of the additive and the fluorocarbon gas so that when the fluorocarbon gas is mixed with the additive and applied to a fire, no more than the target HF emission is given off, wherein the salt is sodium bicarbonate and wherein the additive comprises 3–7% by weight of the admixture.

These and other embodiments of the invention are provided in or are obvious from the following detailed description of the invention.

BRIEF DESCRIPTION OF THE DRAWINGS

The following detailed description given by way of example, but not intended to limit the invention solely to the specific embodiments described, may best be understood in conjunction with the accompanying drawings in which.

DETAILED DESCRIPTION OF THE PREFERRED EMBODIMENTS

Figure 1:
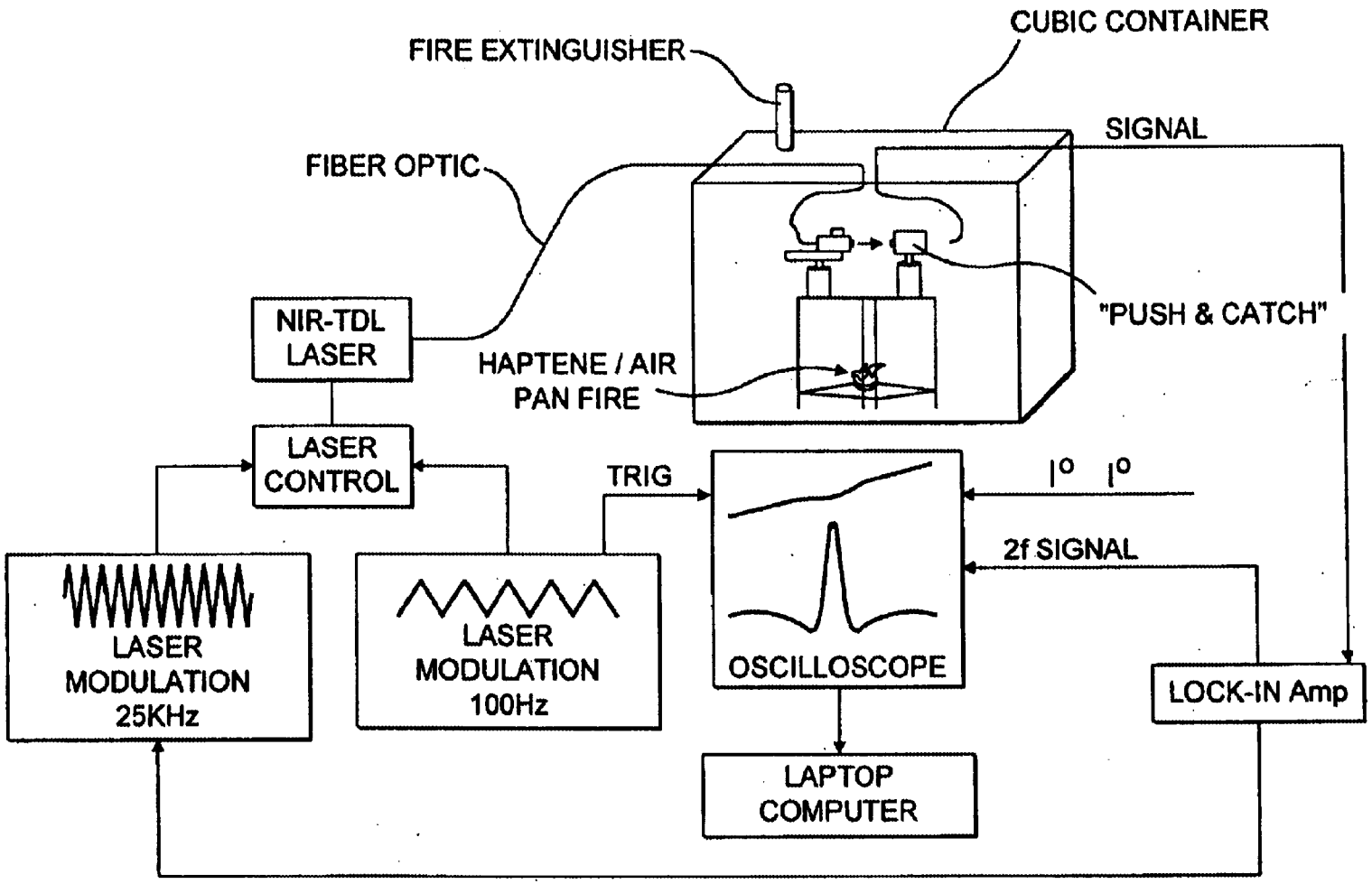
FIG. 1 generally depicts the testing apparatus.

Non-aqueous, flame-extinguishing agents are well-known in the art. This invention is directed to fluorocarbon agents. The inventive gelled additive is represented by salts of weak acids which decompose at temperatures obtained when contacted wit ignited surfaces plurality of particles of a dry powder fire-extinguishing agent dispersed in a gel.

It has been discovered that the addition of gelled powder additives comprising certain amounts of specially ground and gelled salts of weak acids which decompose when contacted with ignited surfaces when suspended in liquefied HFC gases used for fire extinguishing purposes, eliminate or reduce hydrogen fluoride.

The invention comprises a substantially non-aqueous, flame-extinguishing composition for extinguishing a fire at the sight of a potential flame comprising a fluorocarbon in admixture with a gelled powder additive comprising salts of weak acids which decompose at the temperature of the sight to reduce or eliminate HF released by the composition when used to extinguish flames.

The invention also comprises a method to reduce or eliminate HF released while extinguishing fires at the sight of a potential flame comprising by flooding or stream the compositions of the invention at the sight.

It has been discovered that salts of weak acids that decompose when contacted with ignited surfaces reduce HF presence. This may be because the Fluorine binds with the salt or because the presence of these salts slows down the decomposition of the FC to HF.

Preferred dry powder fire-extinguishing agents are solid forms of the ammonium salts, sodium salts, and potassium salts. In more preferred embodiments the salt comprises sodium bicarbonate, potassium bicarbonate, lithium carbonate, ammonium bicarbonate, ammonium carbamate, mono-ammonium phosphate, di-ammonium phosphate, and ammonium polyphosphates. The ammonium polyphosphate and sodium bicarbonate solid particles are preferred dry chemical agents for practice of the present invention. However, it is understood that the preferred salts may be determined by the temperature of the fire being put out. For example the burning temperature of cotton is 180° C. while the burning temperature of various metals would be much higher.

The salt particles should be less than 50 microns and are preferably between 4 and 30 microns, more preferably less than 10 microns. The amount of the chemical agent should be between 2–55% by weight of the admixture, depending on the additive used. In preferred embodiments, 15–20% by weight of specially ground (to less than 10 microns) ammonium polyphosphate (APP) is gelled. In a second preferred embodiment, 3 to 7% by weight specially ground and gelled sodium bicarbonate may be used. Each of these powders has its own particular merits such as classes of fires where it is most effective (for example, wood vs. gasoline).

EXAMPLES

The following examples are set forth to illustrate examples of embodiments in accordance with the invention, it is by no way limiting nor do these examples impose a limitation on the present invention.

The effects of the inventive composition on HF concentrations produced by the decomposition of HFC agents during fire extinguishment were measured by using a 3.625 inch diameter fire pan with 250 ml of heptane as a fuel source, inside a 1.5 cubic diameter Plexiglass enclosure. Varying amounts of the inventive composition were added to heptafluoroproane (FM-200) and hexafluorpropane (FE-36) to study the potential for the inventive composition to scavenge the HF acid gas produced by the decomposition of the FM-200 and FE-36.

Measurement of HF gas concentrations versus time provides a monitor for the fire history and of the effectiveness of any HF-controlling agent used. That is, the time from fire suppressant release until the maximum HF concentration occurs is a measure of the time required for fire extinguishment (also verified visually using the video recorder). The rate at which the HF concentration decreases following extinguishment provides a measure of effectiveness of the controlling agent (when used) or a measure of the rate at which HF gas reacts with the walls of the enclosure. The decrease in the TDL HF levels for fires extinguished using the HFC gas compared to fires extinguished by the HFC gas plus 20% APP (approximately a factor of 22) is partially attributable to the fire suppression properties of APP (reflected by the shorter fire-out times).

Figure 2:
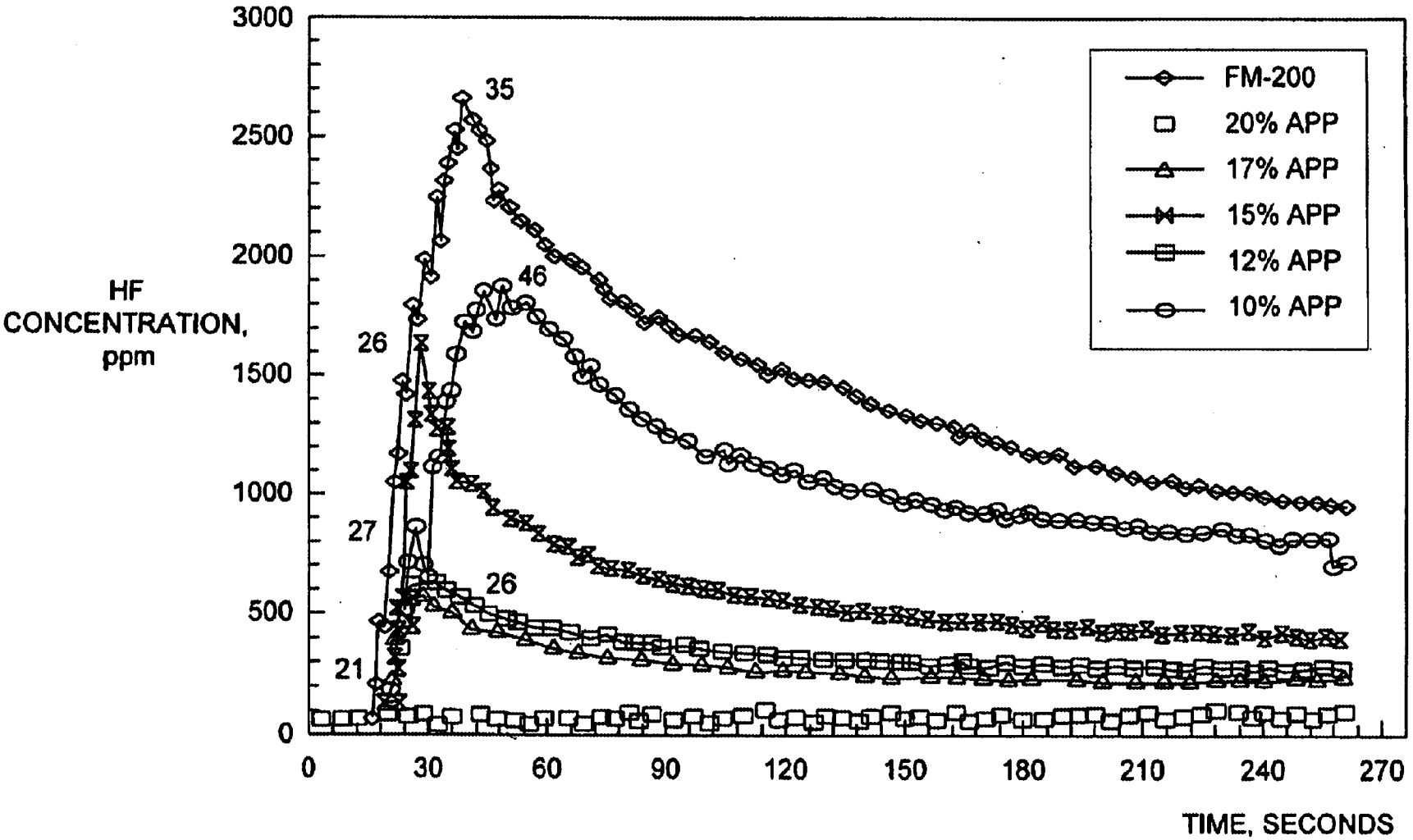
FIGS. 2 and 3 are graphs of the time rate change of HF at various concentrations of APP.
Figure 3:
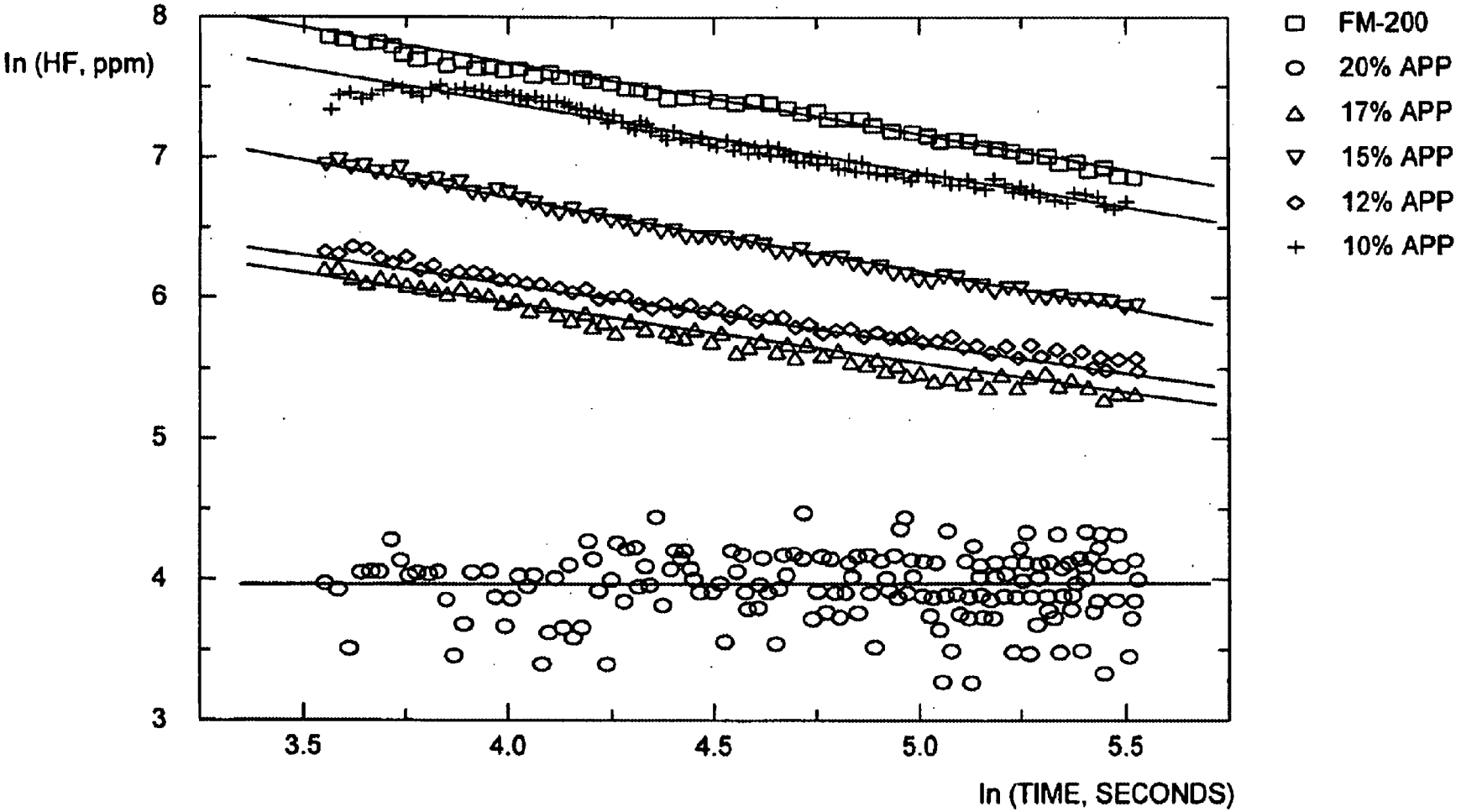

To evaluate the scavenging effects caused by APP, the time rate of change of the concentration was compared between extinguishers containing APP and extinguishers containing only FM-200. The rate of change in HF concentrations can be compared between extinguishers using data from FIG. 2 starting at the maximum HF concentration time (to approx. 26 seconds) and plotting the natural logarithm of the HF concentration versus the natural logarithm of the elapsed time from the HF maximum, as seen in FIG. 3. The time rate of change can be defined as the change in HF concentration normalized to the corresponding change in time. The time rate of change is typically calculated by fitting experimental data to a straight line using linear regression analysis and determining the slope of the line. The slope is defined as the vertical distance (y-axis values) divided by the horizontal distance (x-axis values) between any two points along a straight line which is the rate of change along the line. Since the HF concentrations decrease as a function of time, the concentrations are dissipating Thus, scavenging is implied if the slope value for data from an extinguisher with APP is greater than the slope value for data from fires extinguished by the HFC gas only. The time rate of change of HF concentrations is compared among the various extinguishers is shown in FIG. 3, using the slope values obtained from linear regression analysis of the post-fire HF concentrations measured with the TDL technique. These results indicate that the 15% plus APP extinguisher tests slightly increased the rate of HF dissipation, i.e., increased slope value, with respect to the HF dissipation rate for the fires extinguished only by the HFC gas.

The analysis indicates fires extinguished with only FM-200 produced unacceptably high HF levels, while all the varying degrees of the additive presence of APP reduced HF down to a lower level that the gases alone.

The presence of the tested APP shows a drastic reduction in the generation of HF and all the toxic and corrosive characteristics involved. There appears to be something in the presence of the APP that disrupts the ability of all HFC halon replacements to generate hydrogen fluoride and ammonium Fluoride. The reduction is clearly evident.

In addition to the reduction of HF, not just toxicity is reduced to acceptable levels but corrosion is also reduced.

The above tests demonstrated the ability of the inventive composition to reduce HF concentrations.

Figure 4:
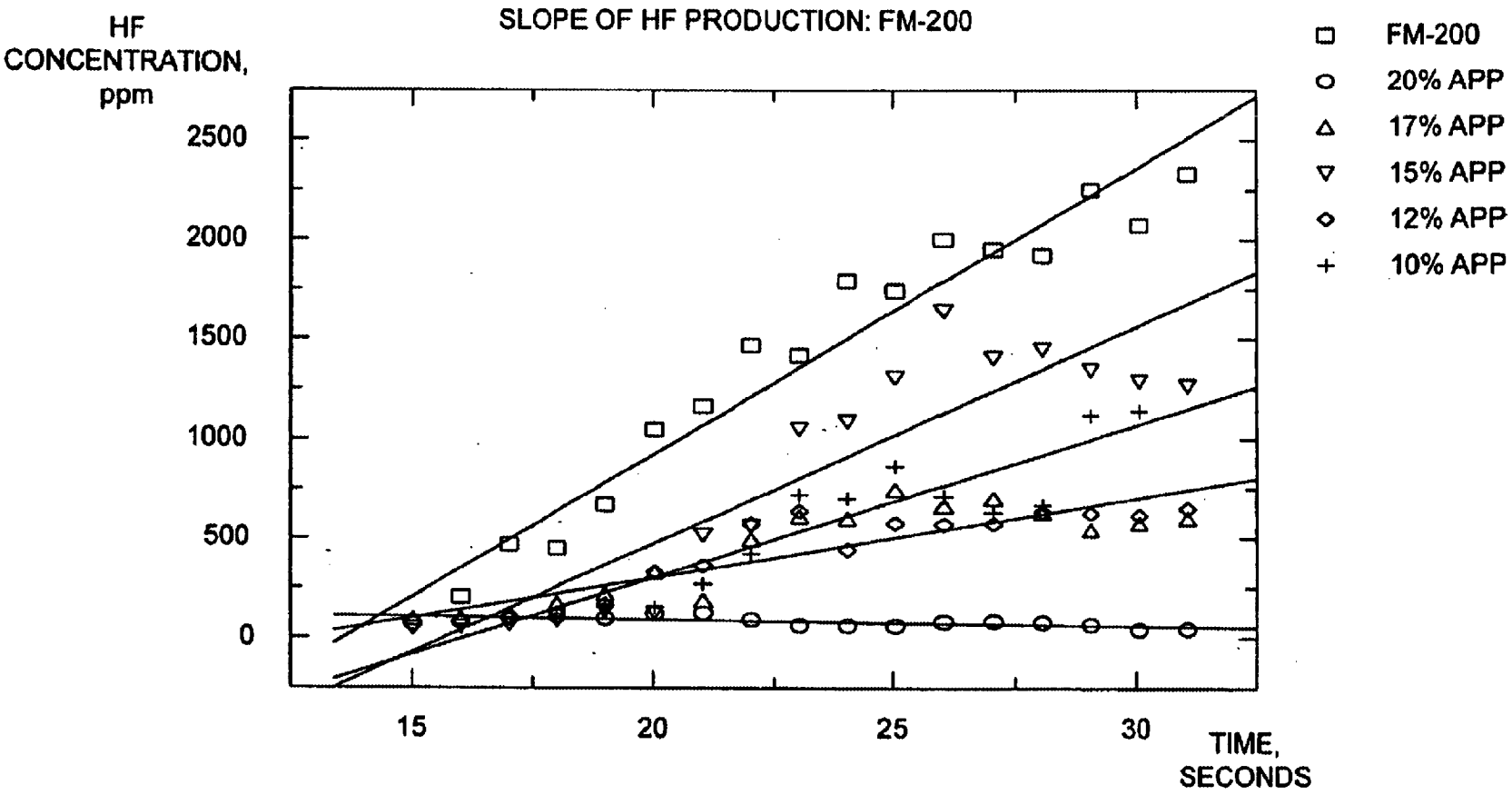
FIG. 4 is a graph of the production of HF over time at various concentrations of APP.

The presence of APP, regardless of the percentage in the extinguisher, helps reduce the overall HF levels with respect to those fires extinguished with FM-200 only in the enclosure. A possible explanation for the HF reductions is that the presence of the combination of APP and the HFC gas at the time of agent application slows the decomposition of FM-100 to HF. Thus, without APP in the enclosure, fires extinguished by the HFC gas alone are able to produce HF more rapidly than fires extinguished by the HFC gas plus APP as shown in FIG. 4.

Figure 5:
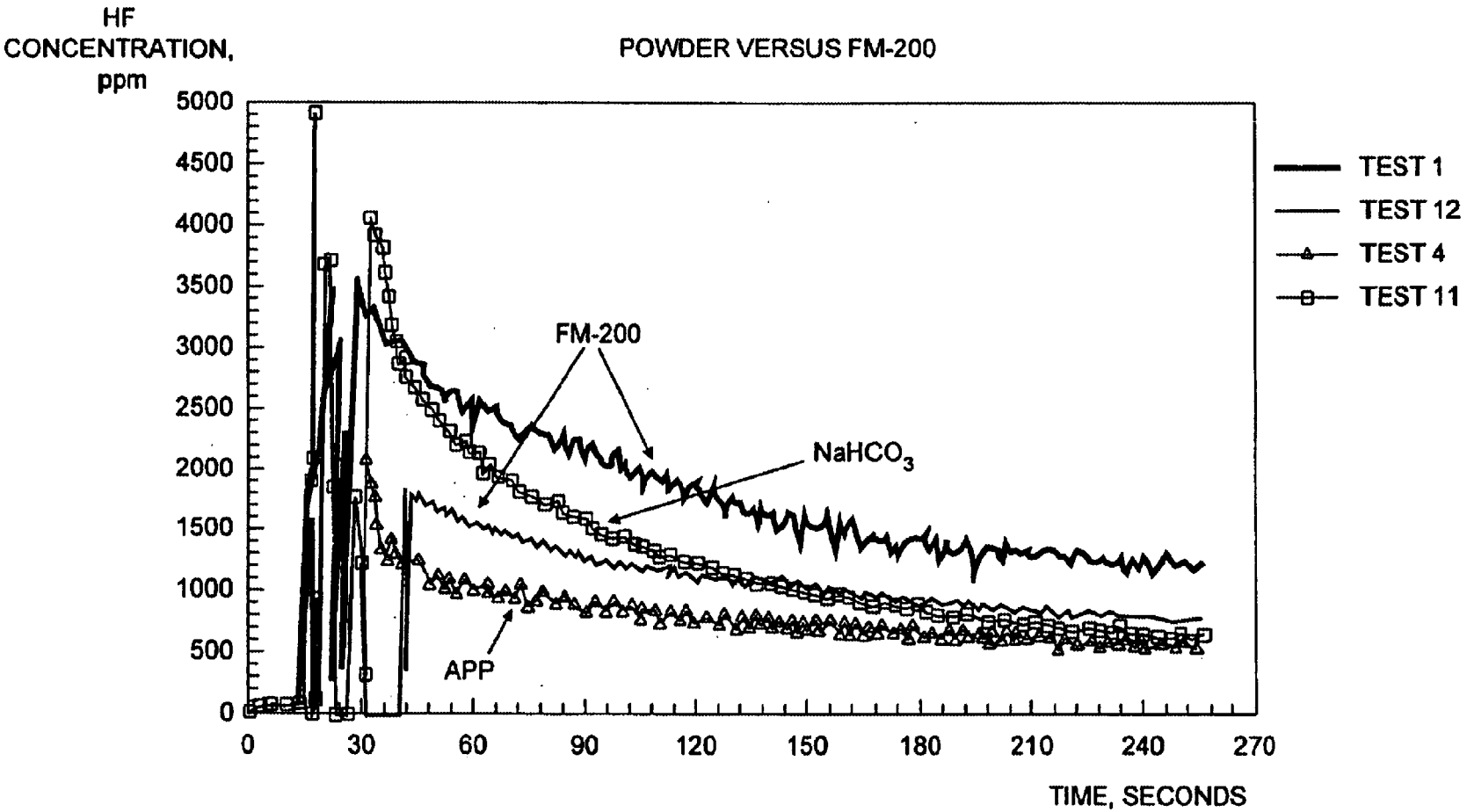
FIGS. 5 and 6 depict graphically the test results regarding the presence of powder in the dissipation of HF.
Figure 6:
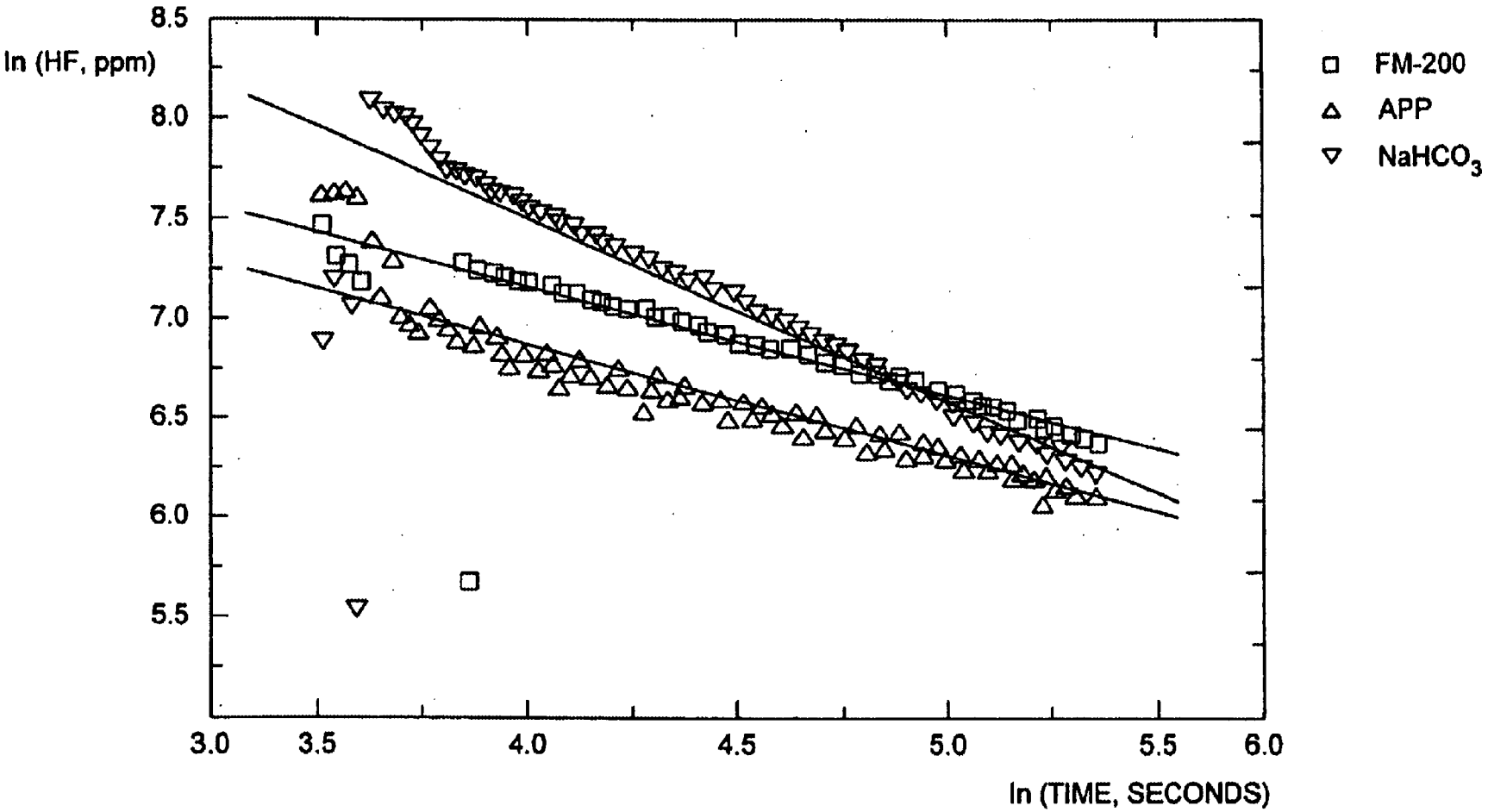

A separate experiment was conducted where $NaHCO_3$ was introduced into the chamber in a separate extinguisher. The intent was to eliminate the fire suppression capabilities of the agents in order to see if either powder reduced HF concentration faster than if no powder was present at all. The results from these tests are presented in FIGS. 5 and 6. The tests indicate that the presence of a powder helps to accelerate the dissipation of HF from the enclosure.

Although preferred embodiments of the present invention and modifications thereof have been described in detail herein, it is to be understood that this invention is not limited to those precise embodiments and modifications, and that other modifications and variations may be affected by one skilled in the art without departing from the spirit and scope of the invention as defined by the appended claims.

What is claimed is:

1. A substantially non-aqueous, flame-extinguishing composition used to extinguish a fire, comprising: a fluorocarbon gas in admixture with approximately 3–7% by weight of a gelled powder additive, said additive comprising salts of weak acids which decompose at the temperature of the fire.

2. The composition according to claim 1, wherein the additive is sodium bicarbonate.

3. The composition according to claim 1, wherein the salt particles are less than 10 microns.

4. A substantially non-aqueous, flame-extinguishing composition used to extinguish a fire, comprising a flame extinguishing fluorocarbon gas component comprising at least one hydrofluorocarbon gas, which produces HF gas when exposed to fire, in admixture with approximately 3–20% by weight of a gelled salt of a weak acid which decomposes when exposed to fire and which reduced the amount of HF gas produced by the hydrofluorcarbon gas, the relative quantities of salt and hydrofluorcarbon gas selected to reduce HF gas production to within a preselected limit.

5. The composition according to claim 4, wherein the salt is selected from the group consisting of sodium bicarbonate, potassium bicarbonate, lithium carbonate, ammonium bicarbonate, ammonium carbonate, mono-ammonium phosphate, di-ammonium phosphate, and ammonium polyphosphates and combination thereof.

6. The composition according to claim 4, wherein the salt component comprises ammonium polyphosphate.

7. The composition according to claim 4, wherein the salt component comprises sodium bicarbonate.

8. The composition according to claim 4, wherein the salt particles are less than 10 microns.

9. The composition according to claim 4, wherein the fluorocarbon gas is selected from the group consisting of heptafluoropropane, hexafluoropropane and combinations thereof.

10. A method of formulating a substantially non-aqueous, flame-extinguishing composition which uses a fluorocarbon gas to extinguish a fire, to reduce the amount of HF given off when the fluorocarbon gas is applied to the fire, comprising: providing a first amount of a fluorocarbon gas which produces HF when exposed to a fire; providing a gelled powder additive, said additive comprising salts of weak acids which decompose at the temperature of the fire; selecting a maximum HF emission target level; and adjusting the relative amounts of the additive and the fluorocarbon gas so that when the fluorocarbon gas is mixed with the additive and applied to a fire, no more than the target HF emission is given off, wherein the salt is an ammonium polyphosphate, and wherein the additive comprises 15–20% by weight of the admixture.

11. A method of formulating a substantially non-aqueous, flame-extinguishing composition which uses a fluorocarbon gas to extinguish a fire, to, reduce the amount of HF given off when the fluorocarbon gas is applied to the fire, comprising: providing a first amount of a fluorocarbon gas which produces HF when exposed to a fire; providing a gelled powder additive, said additive comprising salts of weak acids which decompose at the temperature of the fire; selecting a maximum HF emission target level; and adjusting the relative amounts of the additive and the fluorocarbon gas so that when the fluorocarbon gas is mixed with the additive and applied to a fire, no more than the target HF emission is given off, wherein the salt is sodium bicarbonate and wherein the additive comprises 3–7% by weight of the admixture.

12. The method according to claim 11, wherein the salt particles are less than 10 microns.

13. The method according to claim 12, wherein the salt particles are less than 10 microns.

* * * * *